United States Patent [19]

Bennett et al.

[11] Patent Number: 4,817,411

[45] Date of Patent: Apr. 4, 1989

[54] MANUFACTURE OF METAL EXTRUSIONS

[75] Inventors: Walter Bennett, Farnborough; Peter G. Eden, Churchdown, both of United Kingdom

[73] Assignee: Alcan International Limited, Montreal, Canada

[21] Appl. No.: 878,314

[22] Filed: Jun. 25, 1986

[30] Foreign Application Priority Data

Jul. 1, 1985 [GB] United Kingdom ..... 8516574

[51] Int. Cl.[4] ..... B21C 29/00

[52] U.S. Cl. ..... 72/255; 72/356

[58] Field of Search ..... 72/254, 255, 256, 257; 474/134; 198/813

[56] References Cited

U.S. PATENT DOCUMENTS 3,485,108 12/1969 Lang et al. ..... 474/134

FOREIGN PATENT DOCUMENTS 40267 3/1979 Japan ..... 72/256

4318 1/1982 Japan ..... 72/256

*Primary Examiner*—Lowell A. Larson

*Attorney, Agent, or Firm*—Cooper & Dunham

[57] ABSTRACT

A method of and apparatus for the manufacture of metal extrusions is disclosed in which the metal is extruded through a die having, preferably, a single extrusion aperture. The leading end of the extruded section is gripped and pulled away from the die by a puller 11, and the section is at the same time rapidly and uniformly cooled in a tunnel 8 as extrusion proceeds. When the puller reaches a predetermined distance from the die, the puller and extrusion are stopped simultaneously. The extruded section is then gripped in a device 12 including a pair of gripping jaws adjacent the die and shearing means by which the section is cut through at a location between this pair of jaws and the die. The puller is then operated to move it to stretch the extruded section while the section remains gripped by the gripping jaws of device 12 and in alignment with the die.

7 Claims, 3 Drawing Sheets

MANUFACTURE OF METAL EXTRUSIONS

This invontion relates to the manufacture of extrusions, more particularly metal extrusions.

Extrusion presses for metals, e.g. aluminium, are commonly designed to operate on a regular cycle of alternating extrusion periods and loading periods. During the extrusion period, a ram operates within a container to force a heated metal billet through an extrusion die generally having up to six extrusion apertures, and as extrusion proceeds the extruded sections travel along a wide transfer table. During the subsequent loading period, these extruded sections are moved across the transfer table to a stretching mechanism which stretches the section, generally by about 1%, while the ram is retracted, the remnant of the billet is ejected from the container and another billet loaded into the container for the next extrusion.

Economic factors require that extrusion presses operate at a maximum throughput in terms of weight of metal extruded per hour, and with this objective the extrusion cycle is made as short as possible. The loading period is reduced to a minimum, typically of less than 30 seconds. The extrusion time is also reduced to a minimum by raising the speed of advance of the ram, but an upper limit on this speed is set by the requirement that the extruded metal must not melt in or around the die, for melting spoils the surface finish of the extrudate. This limit on extrusion speed can, however, be raised by artificially cooling the extrusion die e.g. with water or liquid nitrogen. The extrusion alloy chosen is often a compromise between the need for increased extrusion speed (which implies a high melting point material), and the need for an extruded section having defined properties (which may imply a lower melting point material).

The cross-sectional area of the extruded section is generally not the maximum capable of being handled by the press in question. When this is the case, the weight of metal extruded per hour can be increased by the use of an extrusion die having more than one hole. Dies having two to six holes are common. However, a multi-hole extrusion die is more difficult to cool than a single hole die, with the result that part of the increased throughput gained by using a multi-hole die is lost by the need to operate at a slower extrusion speed. The output of an extruder can otherwise be increased to a substantial extent by increasing the speed of extrusion but there is a practical limit imposed by the fact that the loading period cannot easily be reduced and consequently forms an increasing proportion of the total extrusion cycle time.

After emerging from the extrusion die, the extruded sections cool unevenly, as a result of which they become distorted or twisted on the transfer table, and one function of the stretching operation is to remove these distortions. When the extrusion die contains several holes, metal is seldom extruded through all the holes at precisely the same rate, with the result that the extruded sectons vary in length. It is possible to reduce this difference by die correction, but that materially increases extrusion costs. Because of these twists, distortions and variations in length of the extruded sections, the stretching operation is currently labour intensive.

The Applicants have devised a solution to this complex problem of maximising the output of an extruder which involves simultaneously reducing the combined manning requirements of the extrusion and stretching processes.

According to the invention in one aspect there is provided a method of manufacturing an extruded section comprising the steps of employing a puller to grip a leading edge portion of the section being extruded and to pull the section away from the extrusion die as extrusion proceeds, cooling the extruded section rapidly and uniformly as extrusion proceeds, stopping movement of the puller when the puller is a predetermined distance away from the dies and simultaneously stopping extrusion employing gripping means to grip the extrusion at a location adjacent the die, and then increasing the distance between the puller and the gripping means by a predetermined amount to stretch the extruded length while it remains in alignment with the die.

The invention also provides apparatus for the manufacture of extrusions comprising an extruder having an extrusion die, a puller adapted to grip the leading end of an extruded section emerging from the die, and to pull said leading end of the section away from the die as extrusion of the section proceeds, means for rapidly and uniformly cooling the extruded section as extrusion proceeds, gripping means disposed adjacent the die and in alignment with the die lengthwise of the extruded section, which gripping means is operable to grip the extruded section, means for cutting through the section at a location between the gripping means and the die, and means operable to move the puller and gripping means further apart to stretch an extruded section gripped by the puller and the gripping means.

Preferably, the extruded length is severed between the gripping means and the die before stretching of the extruded length is initiated. Preferably also, the gripping means is fixed during the stretching operation, the stretching movement being performed by the puller.

The extruded metal is preferably aluminium, which term is used to cover not only the pure metal but also Al-rich alloys, particularly those of the 6000 series (of Aluminium Association register) which are conventionally used for extrusion.

In order to ensure that the extruded section does not become substantially distorted or twisted, intensive and uniform cooling is generally required immediately downstream of the extrusion die. Although the nature of the intensive cooling is not critical, it is found that forced air or sprayed water is often inadequate. Preferred cooling means comprise highpressure jets of water directed from all sides at the extruded section. It is convenient from all sides at the extruded section. It is convenient to pass the extruded section through a tunnel in which are mounted nozzles to project the high-pressure jets.

When the extrusion die has two or more die apertures, it may be difficult or impossible to cool all extruded sections sufficiently rapidly and uniformly, and it is greatly preferred that an extrusion die having only a single extrusion aperture is used. This has other advantages. Thus the die itself can be intensively cooled, increasing the possible extrusion speed, and the single aperture does not require correction to match other apertures, so reducing the cost of the die. Other advantages are described herein.

According to a preferred feature of the invention, the movement of the puller towards and away from the die is actuated through a cable loop to one run of which the puller is connected, and the stretching movement is also transmitted to the puller through the cable. In one advantageous construction, said cable loop extends about first pulley means adjacent the die and second pulley means remote from the die, said second pulley means comprising two pulleys rotatable about parallel axes on a beam which is itself pivotable about a third axis parallel to and disposed midway between said parallel axes, and there are provided means for applying a brake to at least one of said two pulleys and means for swivelling the beam about said third axis thereby to apply a stretching force to the puller through the cable.

The invention will now be described in more detail with reference by way of example to the accompanying diagrammatic drawings in which.

Figure 1:
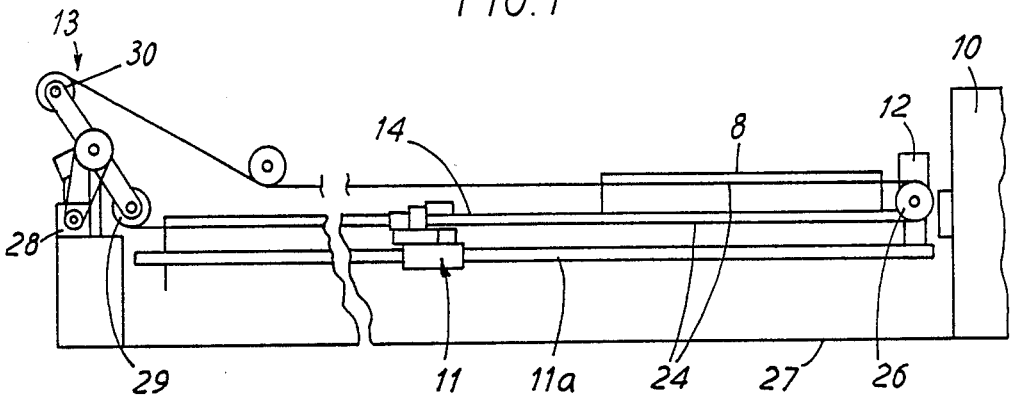
FIG. 1 is a general view of an apparatus incorporating the invention.

Referring first to FIG. 1 of the drawings, the apparatus comprises an extruder 10, a puller 11 which is movable towards and away from the extruder along a guide rail 11*a*, a clamping and shearing head 12 disposed adjacent the extrusion die of extruder 10, and a stretch actuating mechanism 13. The extrusion die has a single die aperture.

At the commencement of a cycle of operations, the puller 11 is disposed adjacent the clamping and shearing head 12 and is operated to grip the leading end of the extruded section which protrudes through the head 12 and to pull the section along a transfer table 14 as extrusion proceeds. The puller generally operates at a constant tension, merely sufficient to prevent the extruded section from buckling or warping, typically of the order of 50–100 kg (0.5–1.0 kN). The extruded section emerging from the die is drawn by the puller through a cooling device in the form of a tunnel 8 in which pressure jets of water are directed on to the section to cool it rapidly and uniformly. The tunnel extends to a point close to the die.

Figure 3:
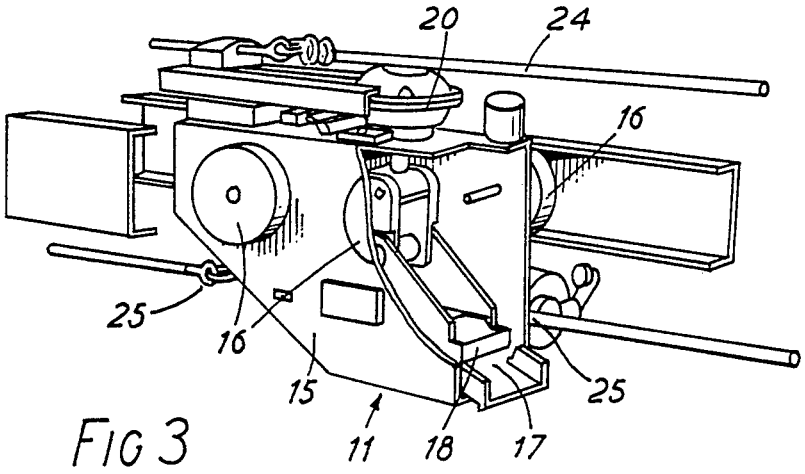
FIG. 3 is a perspective view of the puller of the apparatus, partly cut away to show the construction.

Referring to FIGS. 1 and 3, the puller 11 comprises a trolley 15 equipped with four rollers 16 engaging within twin channel-section guide rails 11*a* so that the trolley rolls along the rails, and a pair of gripping jaws 17, 18. The lower jaw 17 is fixed and the upper jaw 18 is swivelled to open and close the jaws by a pneumatic actuator 20 controlled by a solenoid-operated air valve. The trolley carries an air reservoir 21 which communicates with the air valve and which is automatically replenished each time the pulley returns to its station adjacent the extruder 10.

The puller is driven along the guide rail 11*a* by a loop of steel cable 24 the two ends 25 of which are anchored to the trolley. From one of its anchored ends the cable extends towards the extruder, round a pulley 26 mounted on the frame of the apparatus adjacent the head 13, then to the opposite end of the apparatus where it extends round a series of pulleys, and back to the trolley 15. Electrical signals to operate the solenoid controlling the air valve 21 are transmitted through the cable 24, and the cable pulleys are appropriately insulated from the trolley and the main frame 27 of the apparatus.

When the extruded section reaches the desired length, the puller contacts a line switch (not shown) which stops a reversible electric motor driving cable pulleys 29, 30 forming part of the said series of pulleys at the end of the apparatus remote from the extruder, and which also stops supply of pressure fluid to the ram of the extruder 10. The leading end of the extruded section remains gripped by jaws 17, 18. At this stage the clamping and shearing head 12 shown diagrammatically in FIG. 2 comes into operation.

Figure 2:
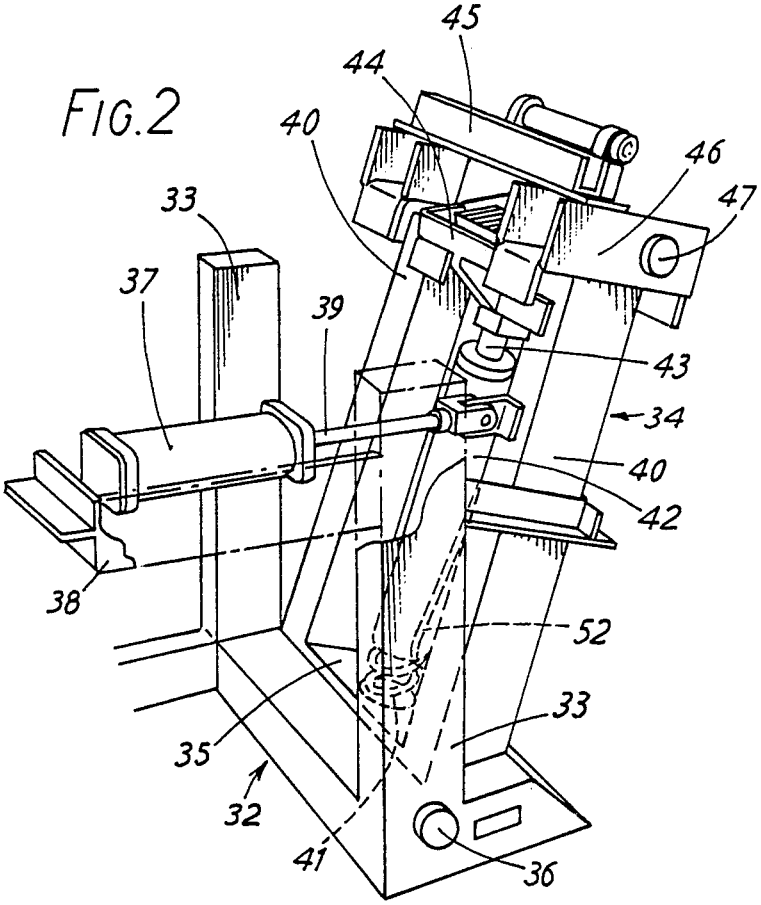
FIG. 2 is a perspective view of the clamping and shearing means of the apparatus.
Figure 2A:
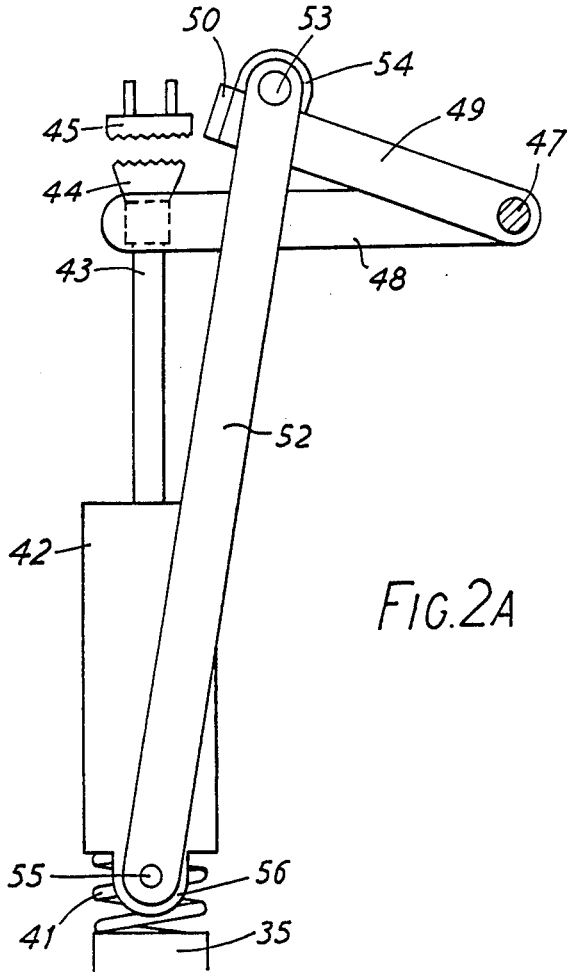
FIG. 2A shows part of the clamping and shearing means of FIG. 2.

Referring now to FIG. 2, the head 12 is supported by a frame 32 mounted on the main frame227 of the apparatus. The frame 32 has two uprights 33 between which is disposed a rectangular sub-frame 34 the bottom crossmember 35 of which is mounted on horizontal pivots 36 carried by the bottom member of the frame 32. A pneumatic actuator 37 has its air cylinder secured to a horizontal limb 38 on one of the uprights 33 and has its actuating rod 39 pivotally connected to one of the uprights 40 of the sub-frame 34 so that the sub-frame can be swung between a vertical position and the position shown in FIG. 2 in which it is tilted towards the extruder. Referring now also to FIG. 2A, the cylinder of a hydraulic actuator 42 is mounted in a slideway between the uprights 40 of the sub-frame so as to swivel with the sub-frame but to be capable of movement axially of itself. A heavy compression spring 41 is disposed between the bottom of the cylinder of the actuator 42 and the bottom crossmember 35 of the sub-frame. The upper end of the rod 43 of actuator 42 carries a gripping jaw 44 which is thus movable towards and away from a fixed jaw 45 mounted on the sub-frame. The two uprights 40 of the sub-frame have parallel T-pieces 46 secured to them which carry between them a pivot rod 47 extending parallel to the pivot 36 of the sub-frame. A first arm 48 (see FIG. 2A) is pivotally mounted on the rod 47 and has its other end pivotally connected to the movable jaw member 44 and rod 43. A second arm 49 pivotally mounted by one end on the pivot rod 47 has secured to its other end a shearing blade 50 which cooperates with the rearward edge of the movable jaw 44 to perform a shearing action, and a link 52 extends between a pivot pin 53 carried by a lug 54 on the second arm and a second pivot pin 55 carried by a lug 56 connected to the bottom end of the hydraulic actuator 42. In operation of the apparatus, the jaws 44, 45 are open and the sub-frame 34 is disposed in its upright position by the pneumatic actuator 37 during the whole of the time during which extrusion is taking place. When the puller 11 is stopped and extrusion ceases, pressure fluid is supplied to the hydraulic actuator 42, and since downward movement of the cylinder is resisted by the spring 41 the rod 43 moves the movable jaw 44 upward and clamps the extrusion firmly against the fixed upper jaw 45. Continued supply of pressure fluid to the cylinder then overcomes the resistance of the spring 41 and the cylinder moves downward pulling the arm 52 and shear blade 50 down to cut through the extruded section, leaving the tail end of the section firmly gripped in the jaws while next a stretching operation is carried out on the extruded length.

Figure 4:
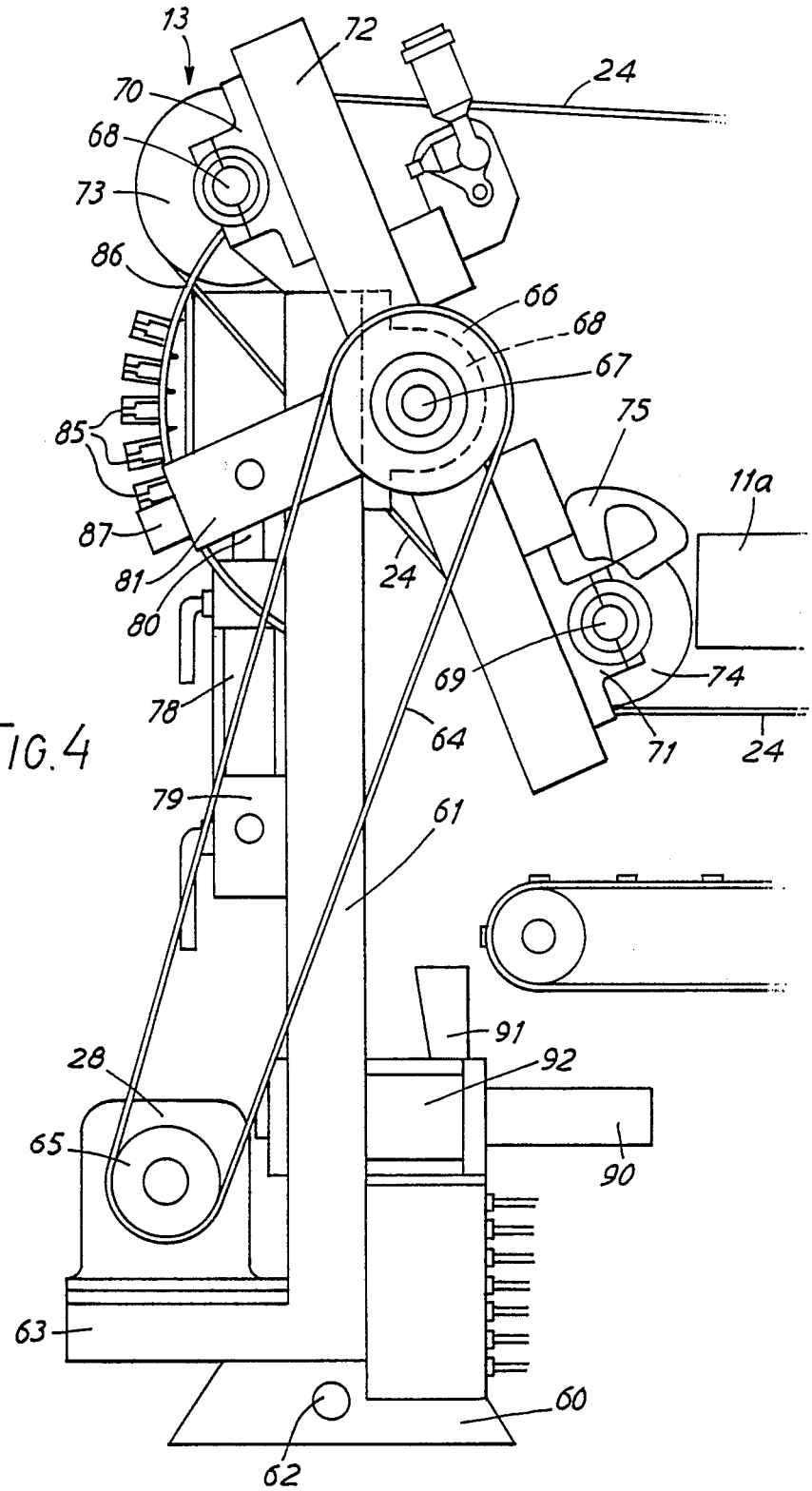
FIG. 4 is a side view of the mechanism for actuating stretching of the extrusion.

The stretching operation is carried out by the puller, actuated by the mechanism 13 illustrated in FIG. 4 to which attention is now directed.

The mechanism is mounted on a base frame 60 secured to the main frame 27 of the apparatus. An upright frame 61 is pivotally moutted by its lower end at 62 on the base frame and on its side further from the extruder has a platform 63 carrying the electric motor 28 which serves to drive the cable loop 24 to which the puller is secured. For this purpose a drive belt 64 extends round a pulley 65 on the motor shaft and round a second pulley 66 secured on one end of a drive shaft mounted in plummer block bearings 68 secured to the upper end of the upright frame 61. Two toothed pulleys (not shown) are secured on the other end of the shaft 67 and toothed belts extending about these pulleys respectively serve to drive two further toothed pulleys (not shown) secured on shafts 68, 69 carried in bearing blocks 70, 71 on a beam 72 which is centrally pivotally mounted on the drive shaft 67. The two shafts 68, 69 have respectively secured to them two pulleys, about which the puller cable 24 extends, and two discs 73, 74 each of which has co-operating with it a disc brake 75. When the brakes 75 are not applied, motor 28 drives the cable 24 through the toothed belts and pulleys and the cable draws the puller along the guide rail 11*a*.

A hydraulic actuator 78 having its cylinder pivotally mounted in trunnions 79 on the upright frame 61 has its actuating rod 80 pivotally connected to one end of an arm 81 which is rigidly secured to the beam 72 so that the actuator 78 operates to swivel the beam about the shaft 67. The shafts 68, 69 of the drive pulleys are equidistantly spaced on opposite sides of shaft 67 and the axes of the three shafts are in a common plane so that swivelling of the beam does not alter the length of the cable loop. When the movement of the pulley away from the die is stopped by the limit switch, the disc brakes 75 are automatically applied and the hydraulic actuator 78 is extended, and the bottom run of the cable 24 is thus drawn towards the upright frame 61 and carries the puller with it which in turn stretches the extruded section. The cable 24 moves as necessary about the pulley 26 adjacent the extruder during this operation.

The extent of swivelling movement of the beam 72 and hence of stretching of the extrusion is adjustable by means of a series of switches 85 spaced along an arcuate strip 86 mounted on the upright frame 61. When an element 87 connected to the free end of the arm strikes the selected switch 85, the hydraulic supply circuit of the actuator is disconnected from the lower end of the actuator cylinder and connected to the upper end of the cylinder to return the beam 72 to its original position. The actuators of the jaws of the puller and the clamping head 12 are then operated to release the extruded section, which is transferred laterally to a conveyor or a receiving table by means not shown, and the motor 28 is reversed to drive the cable in the opposite direction to return the puller rapidly to its starting position adjacent the extruder. At the same time the pneumatic actuator 337 is operated to move the sub-frame 34 to the inclined position in which it is shown in FIG. 2, causing the end of the extrusion to be exposed between the open jaws 44, 45 for gripping by the jaws of the puller. Extruding movement by the ram is then resumed. As soon as the puller has moved away from the head on the next cycle of operations, the sub-frame 34 is returned to its upright position.

In order to maintain a suitable tension in the cable 24 a hydraulic actuator 90 is connected between a part of the fixed frame 60 and the pivoted upright 61, and a wedge 91 then falls under gravity into a gap between one end of an open box part 92 connected to the fixed base and an element (not shown) connected to the upright 61 and projecting vertically into the box. The wedge thus operates automatically to take up any slack in the cable so that the actuator 90 can be deactivated until further tightening adjustment is required.

The apparatus described above has numerous advantages as follows:

(1) The fact that the single extrusion is held in the puller during cooling and subsequent stretching obviates the necessity to locate the end of the section end as is required if one wishes to automate the stretcher on a normal press.

(2) The elimination of a wide cooling transfer table reduces to a remarkable degree the building space required for the press layout.

(3) The fact that sections are cold upon all subsequent handling from the press reduces significantly the damage which occurs when hot sections are moved on a normal press transfer table.

(4) The fact that the time between when a section is extruded and when it is sawn to length amounts to only a few minutes (typically 5 minutes) when compared to a normal press (typically 35 minutes) reduces the risk of defective material being inadvertently produced in large quantities.

(5) The use of dies with a single extrusion aperture on a small container, as opposed to multiple-aperture dies on a large container, enables much closer dimensional tolerances to be achieved.

(6) The fact that a press with a small container and a single-aperture due will extrude much faster (by die cooling, container cooling, section cooling etc) then a multiple-aperture press means that it can achieve the same productivity as or a higher productivity than a large press.

(7) The use of a single-aperture die and a small container as described above provides the option of coating the extrusion with a cladding of a different composition metal to obtain enhanced surface properties.

Thus one obtains full automation, reduced damage, closer tolerances, nnd reduced losses through accidentally produced sub-standard material. In addition, and most importantly, the building space occupied by two or even three small single aperture presses is no greater than the building space occupied by one normal multiple-aperture press. In addition, by the elimination of costly transfer tables (typically 2" container 500 m.ton capacity) for a normal multiplecontainer aperture press (typically 7" container 2,000 m.ton capacity) then the capital cost of the press and its ancillary equipment is considerably less; typically, three presses with all ancillary equipment as described and illustrated would cost the same as one normal multiple-aperture press.

We claim:

1. Apparatus for the manufacture of extrusions comprising an extruder having an extrusion die, first gripping means adapted to grip, at a location closely adjacent the extrusion die, the leading end of an extruded section emerging from the die and to pull said leading end of the section away from the die as extrusion of the section proceeds, means for continuously rapidly and uniformly cooling the extruded section as extrusion proceeds, means co-operating with the first gripping means to stretch the extruded section comprising second gripping means adapted and arranged to grip the extruded section adjacent the die after extrusion of the section has stopped and while the extruded section remains projecting from the die, means for increasing the distance between the first and second gripping means while the extruded section is held by said first and second gripping means and is aligned with the die in the direction of extrusion, and cutting means for cutting through the extruded section between the second gripping means and the die, wherein said second gripping means comprises a member which is swivellable away from and towards the extrusion die into first and second positions respectrively and on which gripping jaws for gripping the extrusion are mounted, whereby when the jaws are opened and the member is swivelled towards the die into said second position, an end portion of the extruded section is exposed for gripping by said first gripping means.

2. Apparatus as claimed in claim 1, wherein said extrusion die has a single extrusion aperture.

3. Apparatus as claimed in claim 1, further comprising a closed loop of cable having a run to which the first gripping means is connected, whereby movement of the first gripping means towards and away from the die is actuated, and wherein the stretching movement is also transmitted to the first gripping means through said cable.

4. Apparatus as claimed in claim 3, wherein means whereby the stretching movement is transmitted to the first gripping means comprises first pulley means adjacent the die and second pulley means remote from the die about which first and second pulley means, said second pulley means comprising for the cable two pulleys rotatable about parallel axes on a beam which is itself pivotable about a third axis parallel to and disposed midway between said parallel axes, means for applying a brake to at least one of said two pulleys, and means for swivelling the beam about said third axis so as when said brake is applied to apply a stretching force to the puller through the cable.

5. Apparatus as claimed in claim 1, wherein means is provided for moving said first gripping means in a direction away from the second gripping means to stretch the extruded section, while said second gripping means is a fixed in said first position.

6. Apparatus as claimed in claim 1, wherein the cutting means comprises a pair of cutting jaws, and a linkage whereby the cutting jaws are linked to the second gripping means for operation in sequence with the second gripping means.

7. A method of manufacturing an extruded section extruded through an extrusion die having a single extrusion aperture comprising gripping the leading end of the extruded section between first gripping jaws at a location closely adjacent the extrusion die, moving said first gripping jaws and said leading end gripped thereby away from the extrusion die and cooling the extruded section continuously rapidly and uniformly as extrusion proceeds, stopping movement of said first jaws at a predetermined distance from the extrusion die, gripping the extruded section in second gripping jaws at a location adjacent the extrusion die, severing the extruded section between said second jaws and the die, and increasing the distance between the first and second jaws by a stretching movement to stretch the extruded section, wherein said second gripping jaws are disposed at a fixed distance from the die during the stretching movement, said stretching movement being carried out by moving the first gripping jaws in a direction away from the second gripping jaws, said method including the further step of moving the second gripping jaws into a position closely adjacent the die preparatory to gripping the leading end of the extrusion between said first gripping jaws.

* * * * *